US011824290B2

(12) United States Patent
Xu et al.

(10) Patent No.: US 11,824,290 B2
(45) Date of Patent: Nov. 21, 2023

(54) CONNECTOR HOUSING LEGS THAT ATTACH THE CONNECTOR TO A CIRCUIT BOARD

(71) Applicant: Tyco Electronics (Shanghai) Co., Ltd., Shanghai (CN)

(72) Inventors: Qin (Candy) Xu, Shanghai (CN); Hongbo (Daniel) Zhang, Shanghai (CN)

(73) Assignee: Tyco Electronics (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 17/474,569

(22) Filed: Sep. 14, 2021

(65) Prior Publication Data

US 2022/0085530 A1 Mar. 17, 2022

(30) Foreign Application Priority Data

Sep. 14, 2020 (CN) ..... 202021998470.9

(51) Int. Cl.
*H01R 12/70* (2011.01)

(52) U.S. Cl.
CPC ..... *H01R 12/7023* (2013.01)

(58) Field of Classification Search
CPC ..... H01R 12/7023; H01R 12/7064; H01R 12/51; H01R 12/523
See application file for complete search history.

(56) References Cited

U.S. PATENT DOCUMENTS

| | | | | |
|---|---|---|---|---|
| 4,664,458 | A * | 5/1987 | Worth | H01R 12/52 439/82 |
| 5,980,314 | A * | 11/1999 | Roberts | H01R 12/7023 439/567 |
| 6,168,463 | B1 * | 1/2001 | Wu | H01R 12/7064 439/567 |
| 7,357,670 | B2 * | 4/2008 | Tanaka | H01R 12/7017 439/79 |
| 8,021,186 | B2 * | 9/2011 | Wang | H01R 12/7023 439/567 |
| 8,435,051 | B2 * | 5/2013 | Tonosaki | H01R 12/7023 439/79 |
| 9,325,088 | B2 * | 4/2016 | Yagi | H01R 12/73 |
| 10,855,009 | B2 * | 12/2020 | Choi | H01L 23/49555 |
| 2022/0173540 | A1 * | 6/2022 | Xu | H01R 13/2471 |

* cited by examiner

*Primary Examiner* — Vanessa Girardi
(74) *Attorney, Agent, or Firm* — Barley Snyder

(57) ABSTRACT

A connector comprises a housing having at least a pair of legs extending from a bottom thereof, and at least one conductive terminal arranged in the housing. Each of the legs includes a body connected to the bottom of the housing and extending downward in a height direction of the housing. A conical guide is connected to a lower end of the body of each leg for guiding the leg into a hole formed in a circuit board. A positioning end is connected to a lower end of the conical guide of each leg and includes a positioning surface extending in the height direction for contacting an inner wall of the hole.

18 Claims, 5 Drawing Sheets

CONNECTOR HOUSING LEGS THAT ATTACH THE CONNECTOR TO A CIRCUIT BOARD

CROSS-REFERENCE TO RELATED APPLICATIONS

This application claims the priority benefit of Chinese Patent Application No. 202021998470.9 filed on Sep. 14, 2020, the whole disclosure of which is incorporated herein by reference.

FIELD OF THE INVENTION

The present disclosure relates to electrical connectors, and more particularly, to electrical connectors and associated housings for attaching to printed circuit boards, for example.

BACKGROUND

Relevant electrical connectors according to the prior art typically comprise a housing and a conductive terminal installed within the housing. In order to install the connector on a circuit board, a bottom of the housing is formed with a plurality of pairs of legs or elastic clips adapted to be inserted into respective holes defined in the circuit board. In order to facilitate insertion, a lower end of the leg is usually formed with an elongated inclined surface for guiding the leg during an insertion operation. However, the guiding inclined surface creates a difficulty ensuring that the connector housing remains horizontal when inserting the leg into the hole of the circuit board. Thus, it is relatively easy to insert the connector in a misaligned or uneven orientation, resulting in the housing tilting in a length direction. Further, there is typically a gap in the width direction of the housing between the leg and the hole of the circuit board. As a result, the housing may also tilt in a width direction after the leg is inserted.

SUMMARY

A connector according to an embodiment of the present disclosure comprises a housing having at least a pair of legs extending from a bottom thereof, and at least one conductive terminal arranged in the housing. Each of the legs includes a body connected to the bottom of the housing and extending downward in a height direction of the housing. A conical guide is connected to a lower end of the body of each leg for guiding the leg into a hole formed in a circuit board. A positioning end is connected to a lower end of the conical guide of each leg and includes a positioning surface extending in the height direction for contacting an inner wall of the hole.

BRIEF DESCRIPTION OF THE DRAWINGS

The invention will now be described by way of example with reference to the accompanying Figures, of which.

DETAILED DESCRIPTION OF THE EMBODIMENTS

Figure 1:
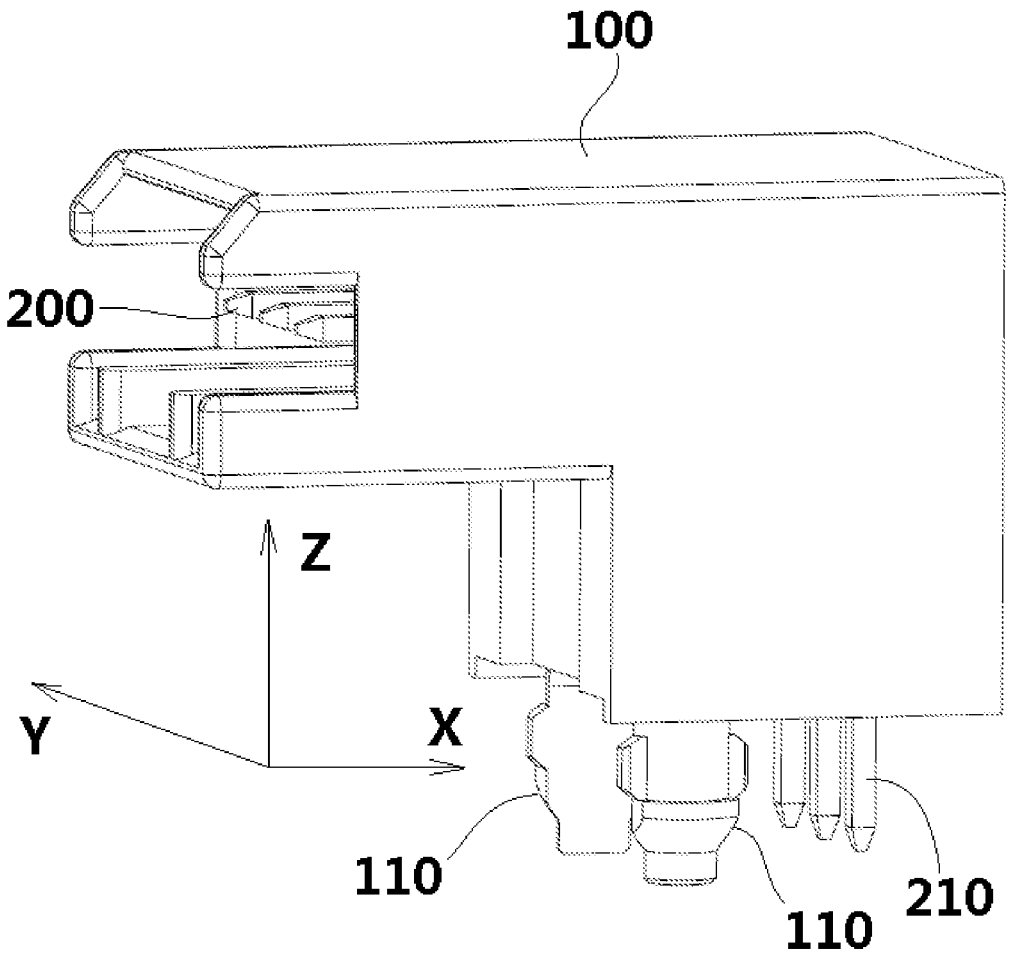
FIG. 1 is a three-dimensional schematic diagram of a connector according to an exemplary embodiment of the present disclosure.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

According to an embodiment of the present disclosure, a connector includes a housing having a width direction and a length direction, and at least one conductive terminal provided in the housing. The housing has at least a pair of legs extending outward from its bottom. Each of the legs includes a body part connected to the bottom of the housing and extending downward along a height direction of the housing, and a conical guide part connected to a lower end of the body part to guide the leg into the hole formed in a circuit board. Each of the leg also includes a positioning end connected to a lower end of the conical guide part. The positioning end has a positioning surface adapted for contacting with an inner wall of the hole and extending along the height direction.

Figure 2:
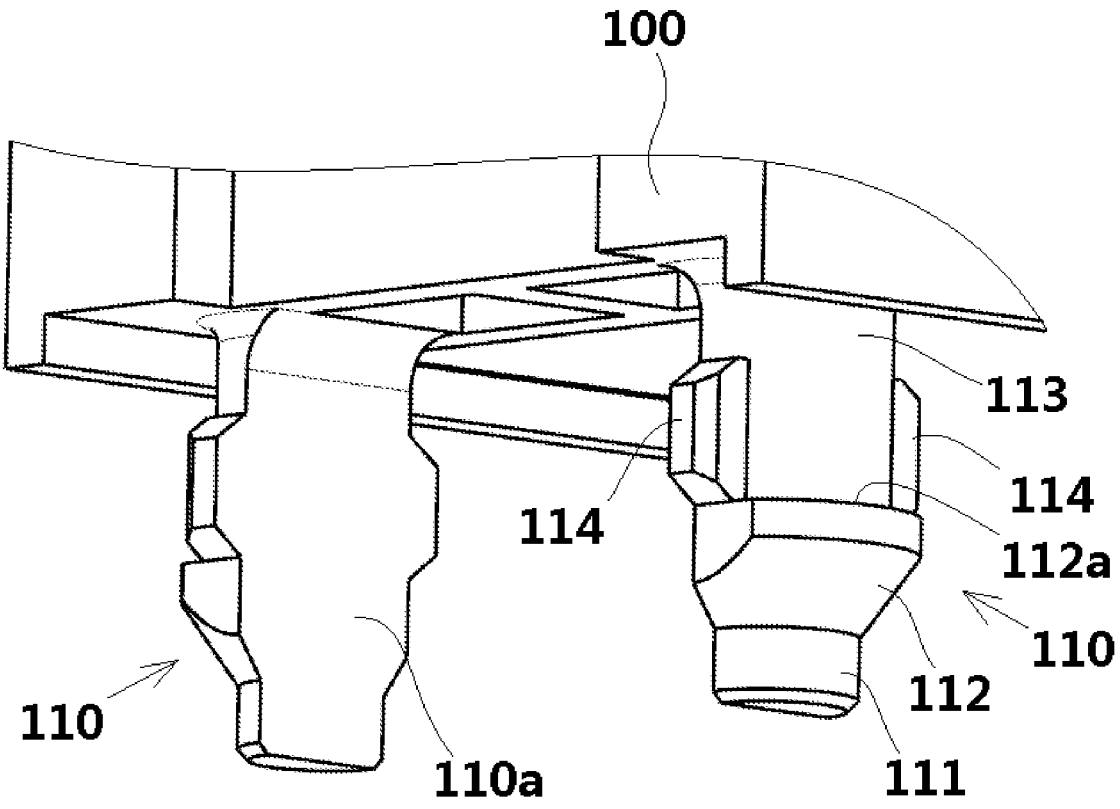
FIG. 2 is a three-dimensional schematic diagram of a leg of the housing of the connector shown in FIG. 1.
Figure 3:
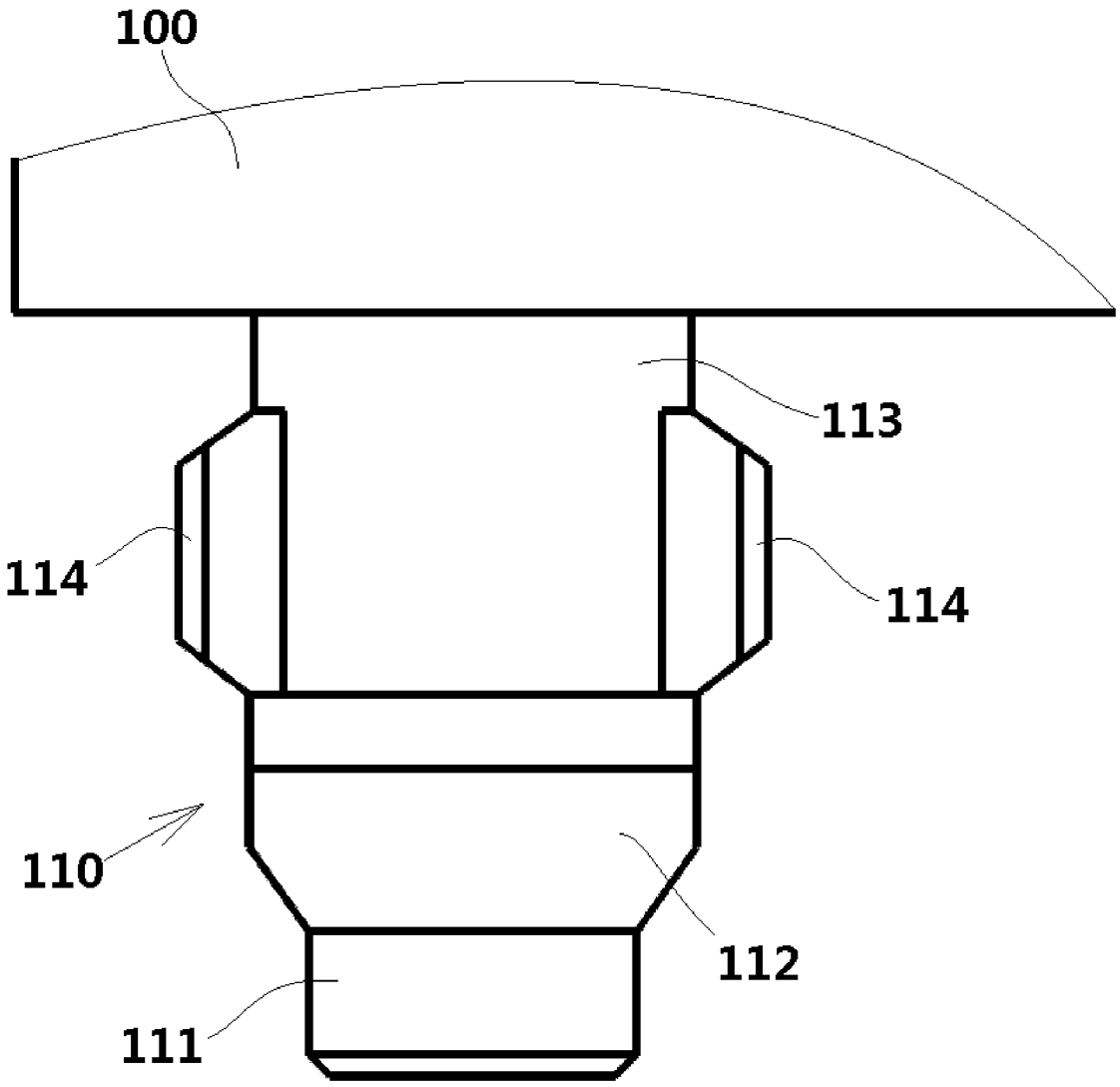
FIG. 3 is a plan diagram of the leg shown in FIG. 2.

FIG. 1 shows a three-dimensional schematic diagram of a connector according to an exemplary embodiment of the present disclosure. FIG. 2 shows a three-dimensional schematic diagram of a leg of the housing of the connector shown in FIG. 1. FIG. 3 shows a plan diagram of the leg shown in FIG. 2.

As shown in FIGS. 1-3, the connector includes a housing 100 and at least one conductive terminal 200 provided therein. The housing 100 has a width direction X and a length direction Y. The housing 100 has at least a pair of legs 110 extending outward from a bottom or underside thereof. Each of the legs 110 includes a body part 113 and a conical guide part 112. The body part 113 is connected to the bottom of the housing 100 and extends downward along a height direction Z of the housing. The conical guide part 112 is connected to a lower end of the body part 113 to guide the leg 110 into a hole 310 formed in a circuit board 300 (see FIGS. 4 and 5). Each pair of legs 110 face each other in the length direction Y and are arranged proximate to two sides of the housing 100 in the length direction Y, respectively. Each of the conductive terminals 200 includes a pin portion 210 extending outward from the bottom of the housing 100.

Figure 4:
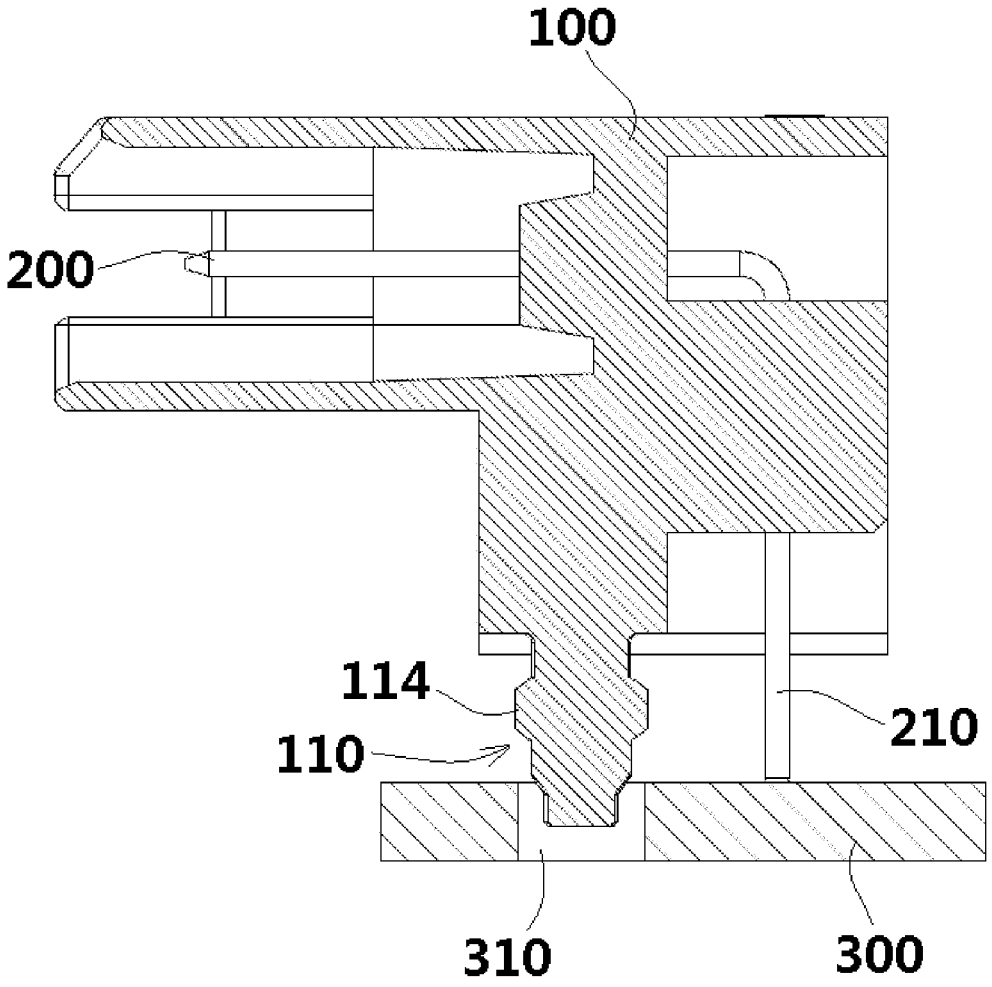
FIG. 4 is a cross-sectional diagram of the connector shown in FIG. 1 along a width direction.
Figure 5:
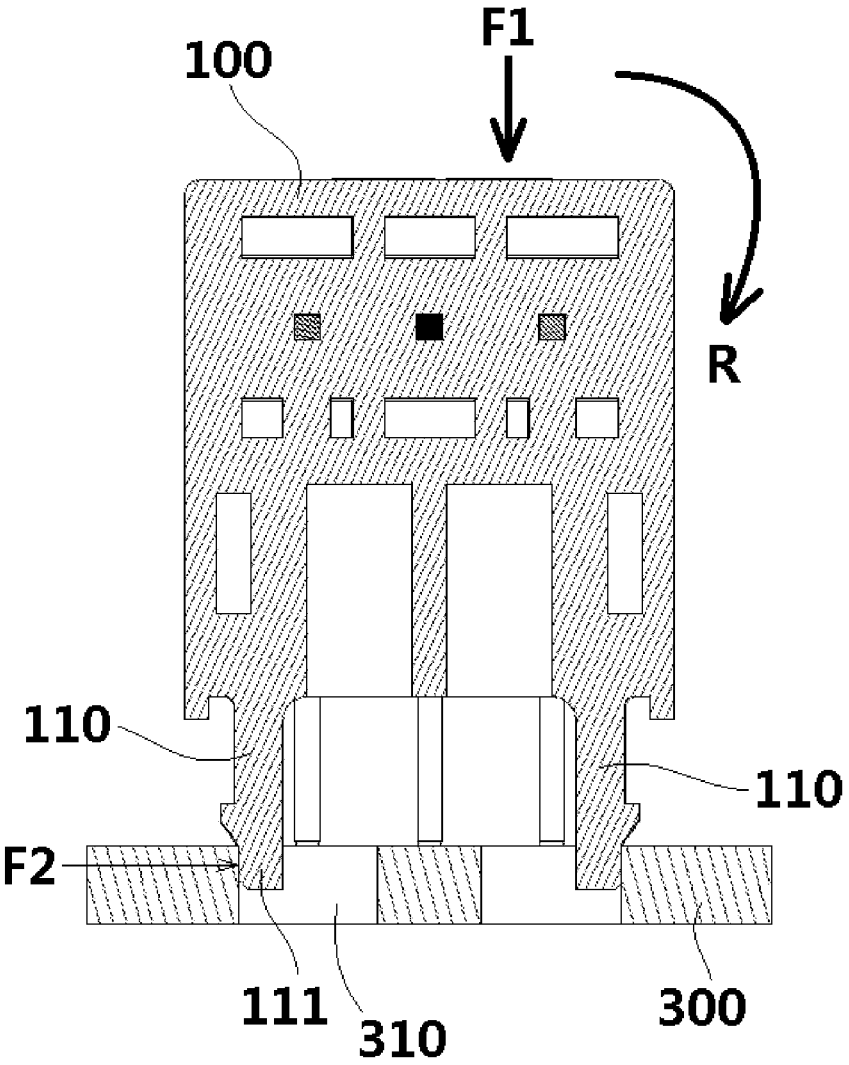
FIG. 5 is a cross-sectional diagram of the connector shown in FIG. 1 along a length direction.

FIG. 4 shows a cross-sectional diagram of the connector shown in FIG. 1 along a width direction, and FIG. 5 shows a cross-sectional diagram of the connector shown in FIG. 1 along a length direction. As shown in FIGS. 1-5, each of the legs 110 also includes a positioning end 111 connected to a lower end of the conical guide part 112. The positioning end 111 has a positioning surface adapted to contact an inner wall of the hole 310 and extends along the height direction Z. In one embodiment, the positioning end 111 is in the shape of a semi-cylinder with a semi-cylindrical outer peripheral surface located on the outside thereof, the semi-cylindrical outer peripheral surface constituting the positioning surface of the positioning end 111.

The conical guide part 112 is shaped as a semi-cone with a conical guiding incline located on the outside thereof. The conical guiding incline is inclined moving vertically upwards in the height direction Z and toward the bottom of the housing 100. More specifically, the diameter of the conical guiding incline gradually increases from bottom to top, and the diameter of a lower portion of the conical guiding incline is equal to the diameter of the positioning surface of the positioning end 111. The conical guide part 112 further defines a horizontal positioning top surface 112*a*, the positioning top surface 112*a* abuts against a bottom surface of the circuit board 300 to prevent the leg 110 from being out of the hole 310 after the leg 110 is inserted into the hole 310 in the circuit board 300.

The body part 113 is semi-cylindrical in shape with a semi-cylindrical outer or exterior peripheral surface. The semi-cylindrical outer peripheral surface of the body part 113, the positioning surface of the positioning end 111 and the conical guiding incline of the conical guide part 112 have the same central axis extending in the height direction Z. The diameter of the semi-cylindrical outer peripheral surface of the body part 113 is smaller than the diameter of an upper portion of the conical guiding incline, but larger than the diameter of the lower portion of the conical guiding incline.

Each of the legs 110 also has a pair of positioning protrusions 114 formed on both sides of the body part 113, respectively and opposite in the width direction X. The pair of positioning protrusions 114 are adapted to interfere with the inner wall of the hole 310 in the circuit board 300, or a top surface thereof, for preventing the connector from tilting in the width direction X after the connector is installed on the circuit board 300.

As can be visualized from the figures, embodiments of the present disclosure prevent the housing 100 from tilting in the length direction when the leg 110 is inserted. Specifically, as shown in FIG. 5, when a downward force F1 applied to the housing 100 is biased to one side in the length direction, the housing 100 has a tendency to rotate in the direction indicated by the arrow R in the figure. At this time, the positioning end 111 of the leg 110 on the other side is in contact with the inner wall of the hole 310, and the inner wall of the hole 310 will apply a reaction force F2 to the positioning end 111 of the leg 110, the reaction force F2 will prevent the rotation of the housing 100. Thus, the housing 100 can be prevented from tilting in the length direction when the leg 110 is inserted.

Likewise, embodiments of the present disclosure prevent the housing 100 from tilting in the width direction when the leg 110 is inserted. As shown in FIG. 4, after the leg 110 is inserted into the hole 310, the pair of positioning protrusions 114 interfere with the inner wall of the hole 310 in the circuit board 300, thereby preventing the housing from tilting in the width direction X after the leg 110 is inserted.

It should be appreciated for those skilled in this art that the above embodiments are intended to be illustrated, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of said elements or steps, unless such exclusion is explicitly stated. Furthermore, references to "one embodiment" of the present disclosure are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. A connector comprising:

a housing having at least a pair of legs extending from a bottom thereof, each of the legs including:

a body connected to the bottom of the housing extending downward in a height direction of the housing;

a conical guide connected to a lower end of the body for guiding the leg into a hole formed in a circuit board; and a positioning end connected to a lower end of the conical guide, the positioning end having a positioning surface for contacting an inner wall of the hole and extending in the height direction, the positioning end having a semi-cylindrical shape with a semi-cylindrical outer peripheral surface defining the positioning surface; and at least one conductive terminal provided in the housing.

2. The connector according to claim 1, wherein each of the conductive terminals includes a pin portion extending outward from the bottom of the housing.

3. The connector according to claim 1, wherein each pair of legs face each other in a length direction of the housing and are arranged proximate to two sides of the housing in the length direction, respectively.

4. The connector according to claim 3, wherein each of the legs further includes a positioning protrusion formed on each side of the body part, the positioning protrusions of each leg extending oppositely in a width direction of the housing, the positioning protrusions adapted to interfere with the inner wall of the hole in the circuit board to prevent the connector from tilting in the width direction after being installed on the circuit board.

5. The connector according to claim 1, wherein the conical guide part is shaped as a semi-cone with a conical guiding incline defined on an exterior thereof.

6. The connector according to claim 5, wherein the conical guiding incline inclines in the height direction, a diameter of the conical guiding incline gradually increasing from a bottom to a top of the conical guide part, a diameter of a lower portion of the conical guiding incline being equal to a diameter of the positioning surface of the positioning end.

7. The connector according to claim 5, wherein the body part has a semi-cylindrical shape with a semi-cylindrical outer peripheral surface, the semi-cylindrical outer peripheral surface of the body part, the positioning surface of the positioning end and the conical guiding incline of the conical guide part having a common central axis extending in the height direction.

8. The connector according to claim 7, wherein a diameter of the semi-cylindrical outer peripheral surface of the body part is smaller than a diameter of an upper portion of the conical guiding incline, and larger than a diameter of the lower portion of the conical guiding incline.

9. The connector according to claim 8, wherein the conical guide part has a horizontal positioning top surface for abutting against a bottom surface of the circuit board to prevent the leg from being removed from the hole after the leg is inserted into the hole in the circuit board.

10. A connector housing having at least a pair of legs extending outward from the bottom thereof, and each of the legs comprising:

a body part connected to a bottom of the housing and extending downward along a height direction of the housing; and a tapering guide part connected to a lower end of the body part to guide the leg into a hole formed in a circuit board, wherein each of the legs further comprises a positioning end connected to the lower end of the tapering guide part and having a positioning surface for contacting with an inner wall of the hole, the body part having a semi-cylindrical shape with a semi-cylindrical outer peripheral surface, the semi-cylindrical outer peripheral surface of the body part, the positioning surface of the positioning end and the tapering guide part having a common central axis extending in the height direction.

11. The connector housing according to claim 10, wherein the positioning end is semi-cylindrical in shape.

12. The connector housing according to claim 10, wherein each of the legs further includes a positioning protrusion formed on each side of the body part, the positioning protrusions of each leg extending oppositely in a width direction of the housing and adapted to interfere with the circuit board to prevent the connector housing from tilting in the width direction.

13. The connector housing according to claim 10, wherein a planar side is positioned opposite the tapering guide.

14. The connector housing according to claim 10, wherein the tapering guide part includes an inclined exterior surface having a diameter increasing from a bottom to a top thereof.

15. The connector housing according to claim 14, wherein a diameter of the semi-cylindrical outer peripheral surface of the body part is smaller than a diameter of an upper portion of the inclined exterior surface of the tapering guide part, and larger than a diameter of the lower portion of the inclined exterior surface of the tapering guide part.

16. A connector assembly comprising:

a circuit board having a hole formed therethrough; and a connector, including:

a housing having at least a pair of legs extending from a bottom thereof and inserted into the hole of the circuit board, each of the legs including:

a body connected to the bottom of the housing extending downward in a height direction of the housing; and a tapering guide connected to a lower end of the body for initially guiding the leg into the hole formed in a circuit board; and a positioning protrusion formed on each side of the body part and extending oppositely in a width direction of the housing and is positioned adjacent the tapering guide; and at least one conductive terminal provided in the housing and electrically connected to the circuit board.

17. The connector assembly according to claim 16, wherein the tapering guide has a horizontal positioning top surface abutting against a bottom surface of the circuit board for preventing the leg from being removed from the hole.

18. The connector assembly according to claim 16, wherein the positioning protrusions interfere with at least one of a top surface of the circuit board or an inner wall of the hole for preventing the connector from tilting in the width direction after being installed on the circuit board.

* * * * *